US005988378A

United States Patent [19]

Bell, Jr.

[11] Patent Number: 5,988,378

[45] Date of Patent: Nov. 23, 1999

[54] IMPLEMENT HOLDER

[76] Inventor: Hillis F. Bell, Jr., 323 W. 6th St., Larned, Kans. 67550

[21] Appl. No.: 08/941,804

[22] Filed: Oct. 3, 1997

[51] Int. Cl.[6] ..... A63B 57/00

[52] U.S. Cl. ..... 206/315.2; 150/160; 206/315.6

[58] Field of Search ..... 150/160; 206/315.2–315.7

[56] References Cited

U.S. PATENT DOCUMENTS

| | | | |
|---|---|---|---|
| 2,014,589 | 9/1935 | Saad | 150/160 X |
| 2,128,546 | 8/1938 | Venmore | 150/160 X |
| 2,508,525 | 5/1950 | Le Fevre | 150/160 |
| 2,705,039 | 3/1955 | Halter | 150/160 |
| 2,752,973 | 7/1956 | Stamp | 206/315.6 |
| 2,879,819 | 3/1959 | Turnbull | 150/160 X |
| 3,053,298 | 9/1962 | Stamp | 206/315.2 |
| 3,117,609 | 1/1964 | Pio | 150/160 |
| 3,613,760 | 10/1971 | Koehnle | 150/160 |
| 3,664,399 | 5/1972 | Neff | 150/160 |
| 3,667,078 | 6/1972 | Distasio | 206/315.4 X |
| 3,842,876 | 10/1974 | Cristelli | 206/315.4 |
| 3,892,267 | 7/1975 | Bibeau | 150/160 |
| 3,985,229 | 10/1976 | Maki | 206/315.6 |
| 4,173,241 | 11/1979 | Stock | 206/315.6 |
| 4,195,677 | 4/1980 | Hagg et al. | 150/160 |
| 4,332,283 | 6/1982 | Rader | 206/315.6 |
| 4,368,768 | 1/1983 | Cunko, Jr. | 150/160 |
| 4,378,832 | 4/1983 | Thompson | 150/160 |
| 4,497,404 | 2/1985 | Lowrance | 150/160 |
| 4,522,300 | 6/1985 | Hamblet | 206/315.4 |
| 4,664,382 | 5/1987 | Palmer et al. | 206/315.6 X |
| 4,746,014 | 5/1988 | Very | 206/315.6 |
| 4,838,416 | 6/1989 | Carman | 150/160 X |
| 4,932,523 | 6/1990 | Yamazoe | 206/315.2 X |
| 4,938,349 | 7/1990 | Burns | 206/315.6 |
| 4,971,126 | 11/1990 | Borenstein | 150/160 |
| 5,000,238 | 3/1991 | Zeller | 150/160 |
| 5,005,624 | 4/1991 | Sung | 150/160 |
| 5,088,600 | 2/1992 | Kopp, Jr. | 150/160 X |
| 5,133,395 | 7/1992 | Moore | 150/160 |
| 5,238,109 | 8/1993 | Smith | 206/315.2 |
| 5,275,278 | 1/1994 | Henry et al. | 150/160 X |
| 5,284,194 | 2/1994 | Gaffney | 150/160 |
| 5,332,090 | 7/1994 | Tucker | 206/315.4 |
| 5,345,987 | 9/1994 | Hagar | 150/160 |
| 5,415,213 | 5/1995 | Diener et al. | 150/160 |
| 5,437,320 | 8/1995 | Sung | 150/160 |
| 5,522,592 | 6/1996 | Evelsizer, Jr. | 150/160 |
| 5,575,720 | 11/1996 | Daniel | 150/160 X |
| 5,755,322 | 5/1998 | Yang | 206/315.2 |

*Primary Examiner*—Sue A. Weaver
*Attorney, Agent, or Firm*—Mark E. Brown; Litman, Kraai & Brown LLC

[57] ABSTRACT

An implement holder includes a head assembly with first and second arms for releasably, securely retaining the head of an implement. The head assembly is mounted on an upper end of a tube assembly, which is length-adjustable and adapted for mounting on a receptacle by a clip subassembly. The head assembly includes a strap subassembly for releasably securing the implement head.

2 Claims, 5 Drawing Sheets

IMPLEMENT HOLDER

BACKGROUND OF THE INVENTION

1. Field of the Invention

The present invention relates generally to sports implements, and in particular to a holder for retaining a golf club in a protected position in a golf bag.

2. Description of the Prior Art

Various types of activities involve the use of specifically designed implements. For example, many sports are played with specialized equipment. Playing a round of golfing normally involves transporting a set of golf clubs around a course while playing the individual holes in a predetermined sequence.

A set of golf clubs is commonly kept in a golf bag. Golf bags are typically carried on golf carts, shoulder-carried by players and caddies, and pulled on specially-designed wheeled devices. In transit, the individual clubs in a golf bag are typically thrown against each other, with the attendant risk of damage. The woods in a golf club set are particularly susceptible to impact damage as they strike each other and the other clubs in a golf club set.

A previous solution to this problem involved placing covers over the heads of the woods for the purpose of protecting them against impact-related damage. The covers are typically externally marked to indicate the type of club thereunder. Such covers can provide a measure of protection for the golf club heads, but they have several shortcomings. For example, the normal type of golf club head cover does not provide any protection for the golf club shaft. The shafts of a set of golf clubs are thus free to impact each other in response to movement of the golf bag in transit. Prior art club head covers also tend to slow down golf play as they are removed and replaced on the individual clubs. For example, many golfers find themselves removing and replacing at least one head cover per hole. It will be appreciated that using a set of golf clubs would be considerably more convenient and a round of golf could be played more efficiently if the numerous head cover removal and replacement procedures currently performed by players could be eliminated. Moreover, golf club head covers are generally not designed for retaining the golf clubs in the golf bag.

Other types of implements can also benefit from protective holders. For example, in the field of sports implements, hockey sticks, crochet mallets, polo mallets, etc. can benefit from the protection afforded by a set of holders.

Heretofore, there has not been available an implement holder with the advantages and features of the present invention.

SUMMARY OF THE INVENTION

In the practice of the present invention, an implement holder is provided for holding an implement, such as a golf club, with a head and a shaft. Multiple implement holders can hold a set of golf clubs in a golf bag. The holder generally includes a head assembly with first and second arms for capturing the implement head and an adjustable-length tube assembly for receiving the implement shaft. Both the head and tube assemblies are lined with a suitable soft protective material, such as velour or sheepskin, for providing protection for the implement head and shaft respectively. The head assembly is mounted on an upper end of the tube assembly. The tube assembly can be removably mounted on a receptacle, such as a golf bag, by a clip subassembly.

OBJECTS AND ADVANTAGES OF THE INVENTION

The principal objects and advantages of the present invention include: providing an implement holder; providing such an implement holder for implements with heads and shafts; providing such an implement holder which is adapted for securely holding a golf club in a golf bag; providing such an implement holder which can be used in multiples for holding a set of golf clubs in a golf bag; providing such an implement holder with a length-adjustable tube assembly; providing such an implement holder with a head assembly which is adjustable to accommodate different implement heads; and providing such an implement holder which is economical to manufacture, efficient in operation, capable of a long operating life and particularly well adapted for the proposed usage thereof.

Other objects and advantages of this invention will become apparent from the following description taken in conjunction with the accompanying drawings wherein are set forth, by way of illustration and example, certain embodiments of this invention.

The drawings constitute a part of this specification and include exemplary embodiments of the present invention and illustrate various objects and features thereof.

DETAILED DESCRIPTION OF THE PREFERRED EMBODIMENTS

I. Introduction and Environment

Figure 1:
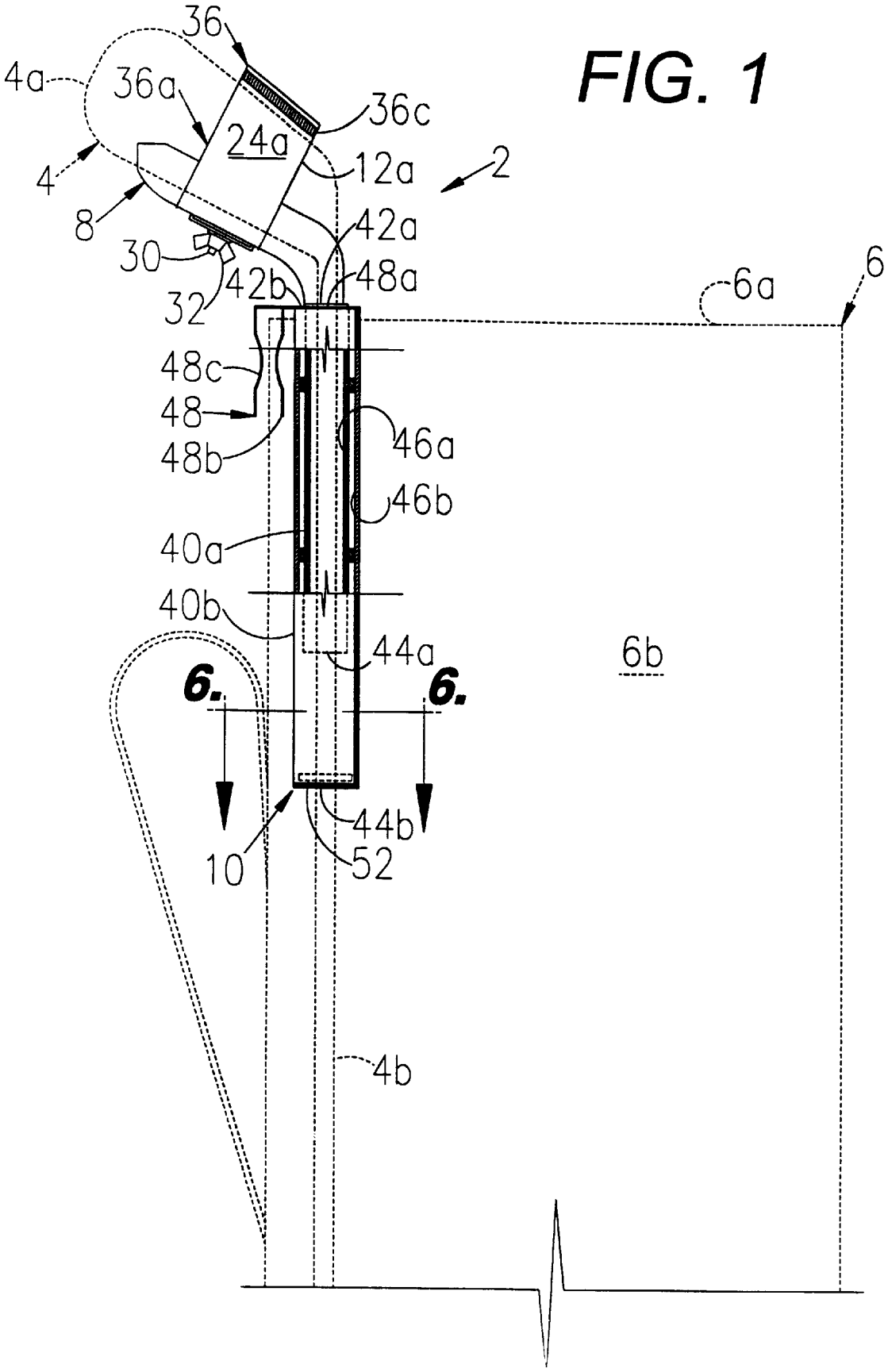
FIG. 1 is a side elevational view of an implement holder embodying the present invention, shown holding a golf club in a golf bag.
Figure 2:
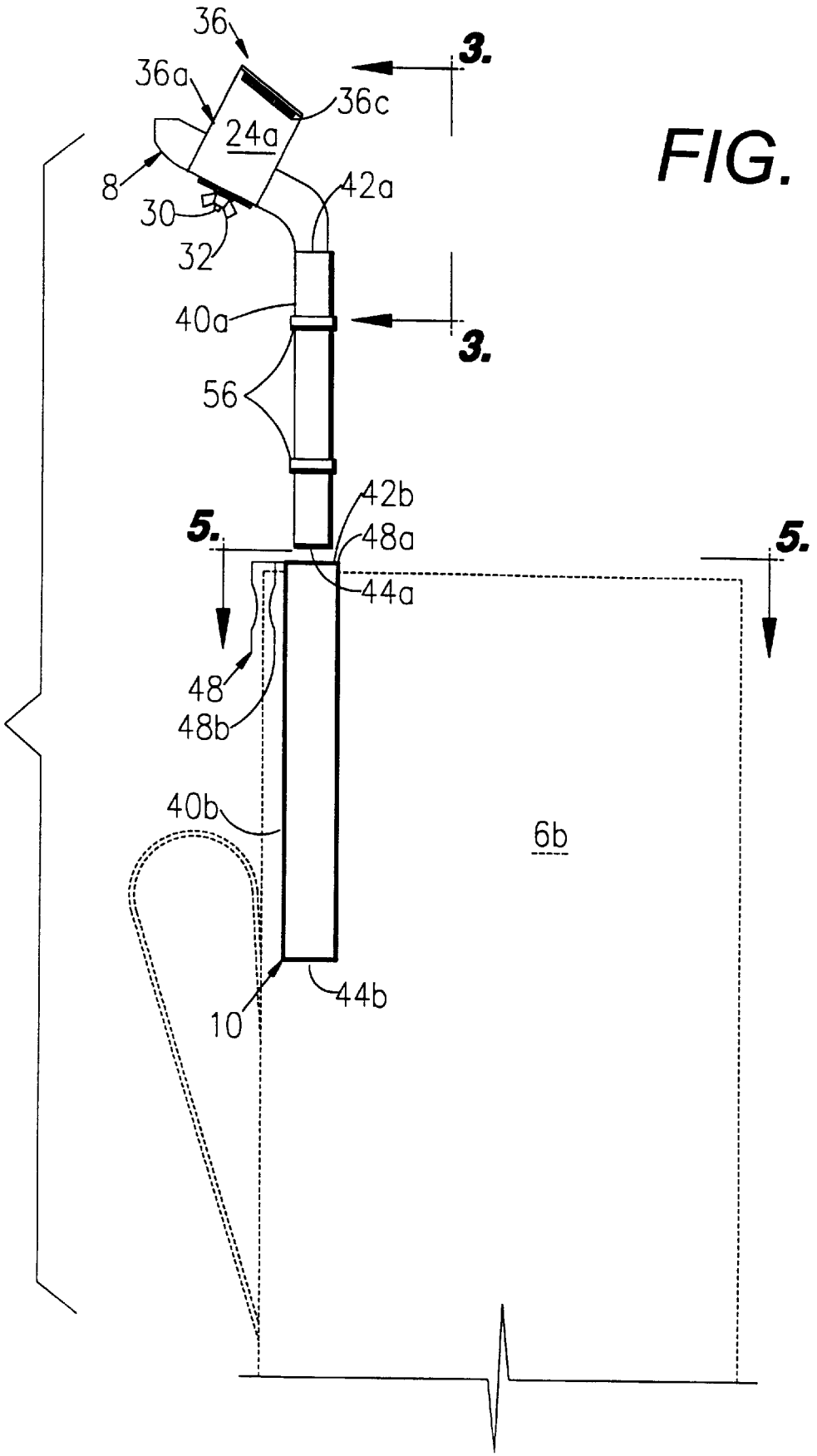
FIG. 2 is an exploded, side elevational view of the implement holder.
Figure 6:
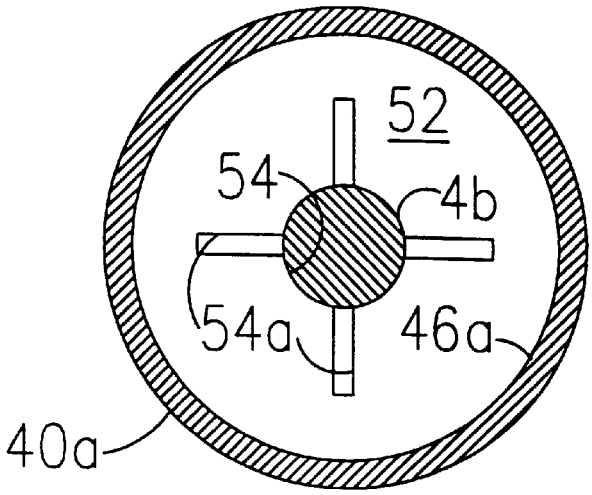
FIG. 6 is a horizontal, cross-sectional view of the implement holder taken generally along line 6—6 in FIG. 1 and particularly showing an insert in the tube assembly of the implement holder.
Figure 3:
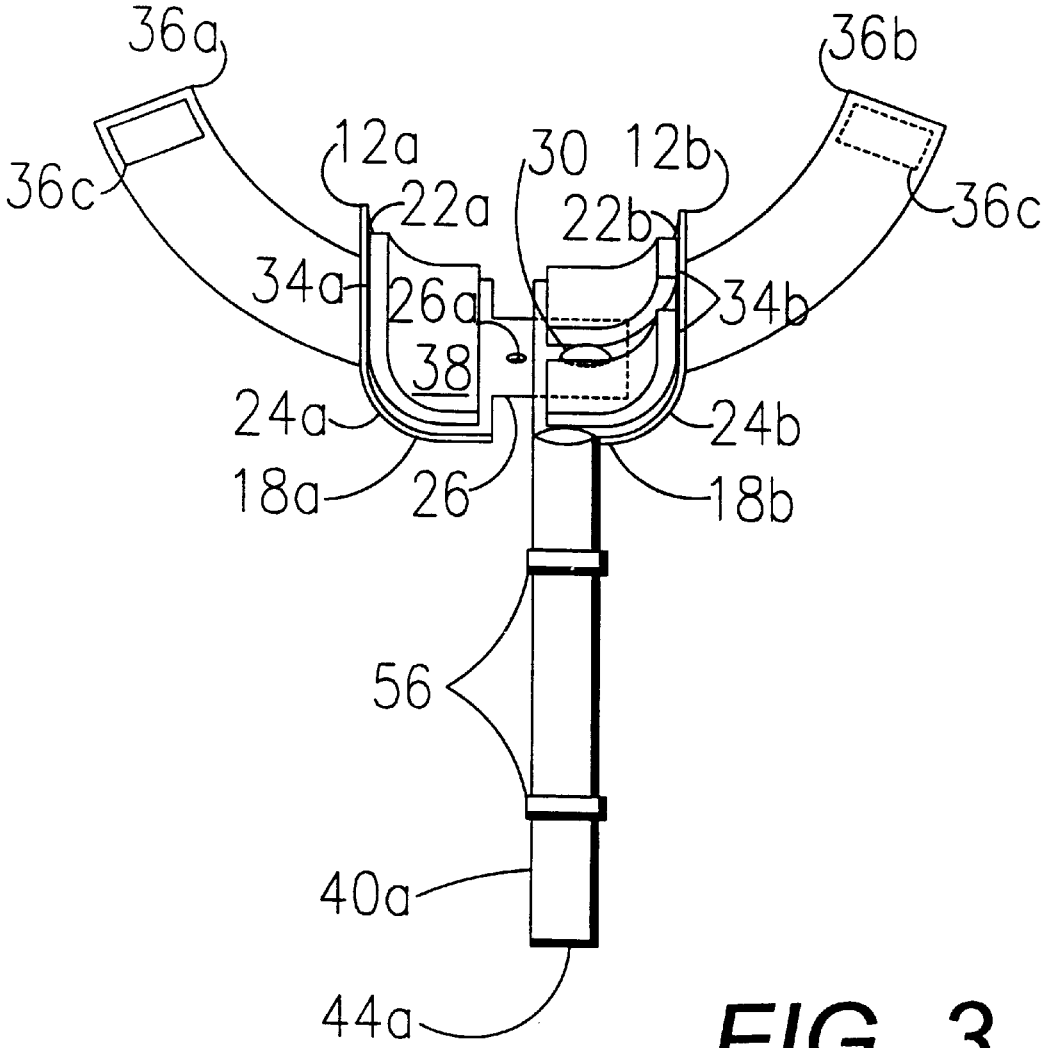
FIG. 3 is a side elevational view of the implement holder, taken generally along line 3—3 in FIG. 2.
Figure 3A:
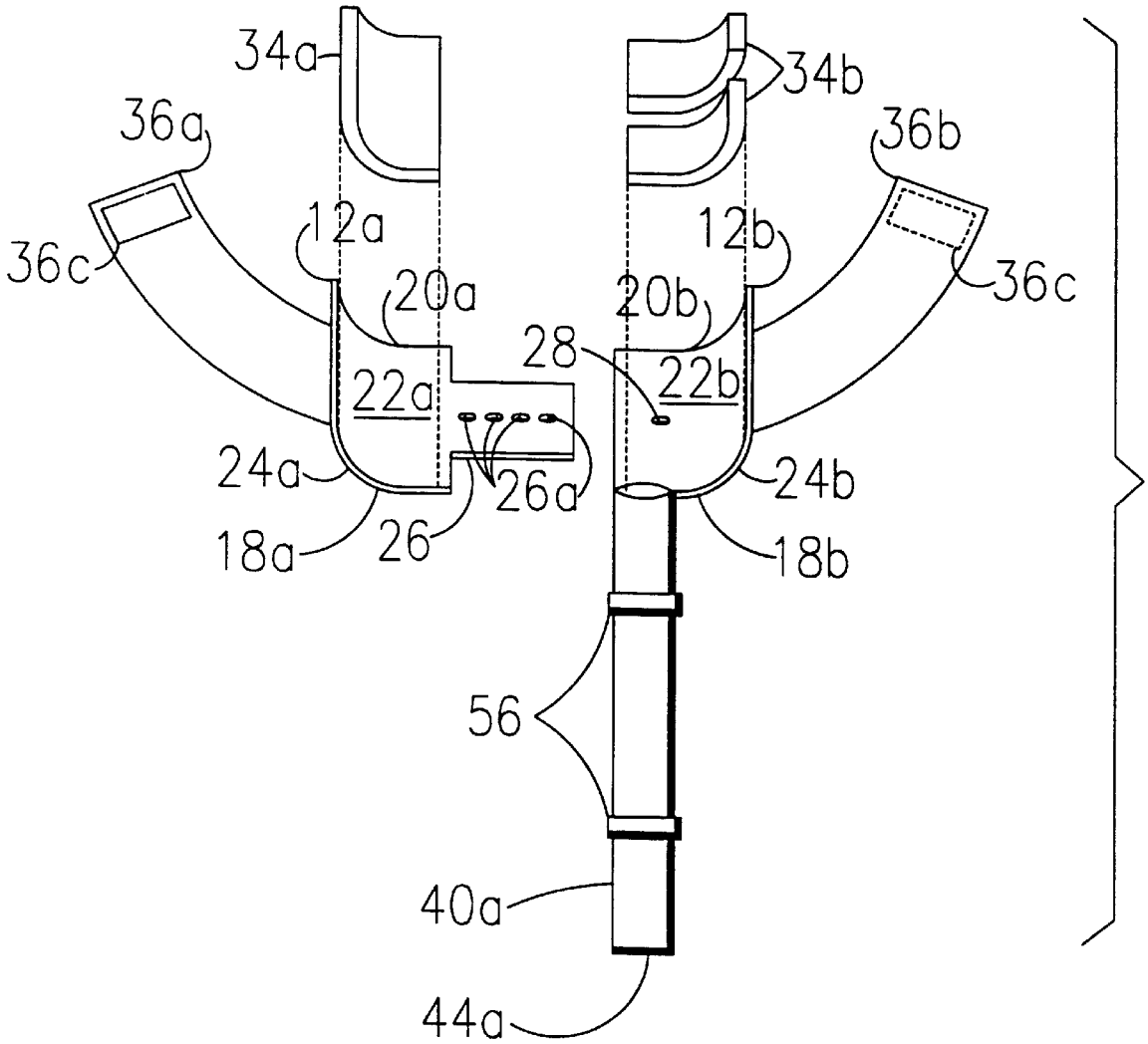
FIG. 3*a* is an exploded view of the implement holder.
Figure 4:
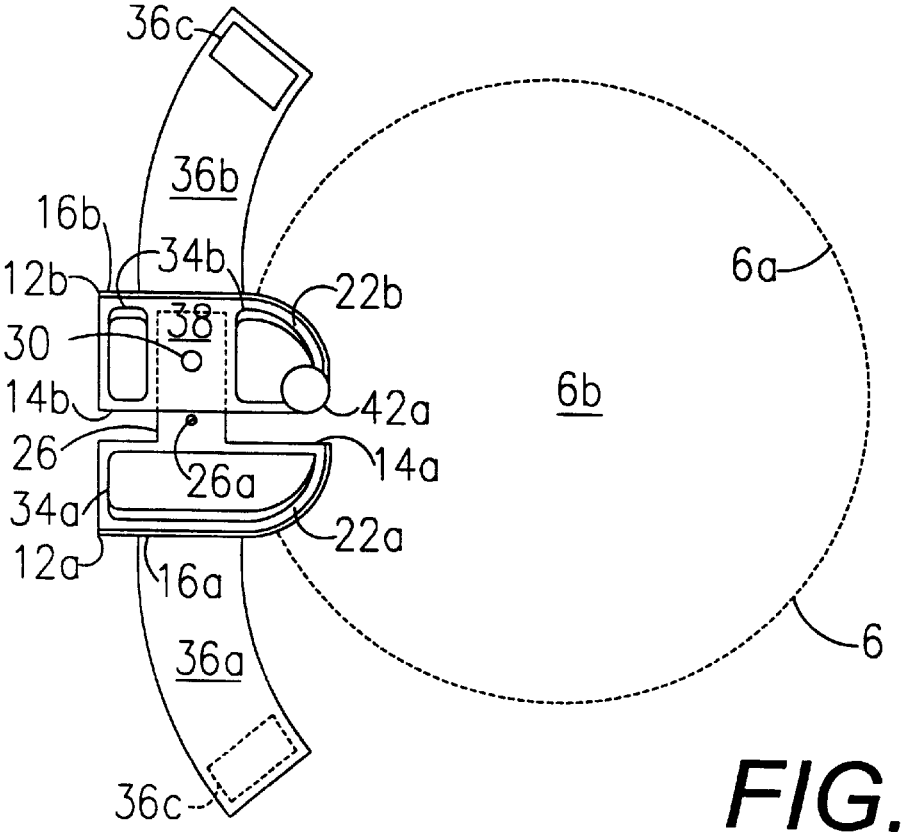
FIG. 4 is a top plan view of the implement holder.
Figure 5:
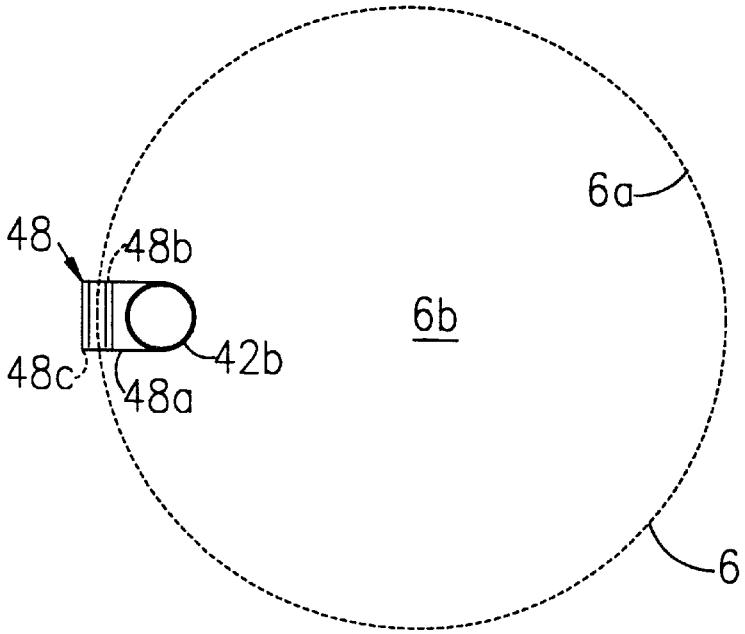
FIG. 5 is a cross-sectional view of the implement holder taken generally along line 5—5 in FIG. 2.

As required, detailed embodiments of the present invention are disclosed herein; however, it is to be understood that the disclosed embodiments are merely exemplary of the invention, which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Certain terminology will be used in the following description for convenience in reference only and will not be limiting. For example, the words "upwardly", "downwardly", "rightwardly", and "leftwardly" will refer to directions in the drawings to which reference is made. The words "inwardly" and "outwardly" will refer to directions toward and away from, respectively, the geometric center of the embodiment being described and designated parts thereof. Said terminology will include the words specifically mentioned, derivatives thereof and words of a similar import.

Referring to the drawings in more detail, the reference numeral 2 generally designates an implement holder embodying the present invention. Without limitation on the generality of useful applications of the present invention, the implement holder 2 is designed to hold a golf club 4 including a head 4*a* and a shaft 4*b* in a golf bag 6 with a golf bag rim 6*a* and a golf bag interior 6*b*.

The implement holder 2 generally includes a head assembly 8 and a tube assembly 10.

II. Head Assembly 8

The head assembly 8 includes first and second arms 12*b,a* with proximate ends 14*a,b*; distal ends 16*a,b*; inner sides 18*a,b*; outer sides 20*a,b*; upper faces 22*a,b*; and lower faces 24*a,b*. The arms 12*a,b* curve upwardly and outwardly from their proximate ends 14*a,b* to their distal ends 16*a,b* to form an upwardly-open, concave receptacle 38.

The first arm 12*b* includes a receiver 28 positioned in spaced relation between the proximate and distal ends 14*a*, 16*a* thereof. The second arm 12*a* includes a flange 26 projecting laterally from its proximate end 14*b*, which flange 26 includes a plurality of receivers 26*a*. A mounting bolt 30 extends through a respective flange receiver 26*a* and the receiver 28 and threadably mounts a wing nut 32. First and seconds pads 34*a,b* are mounted on the upper faces 22*a,b* of the arms 12*a,b* respectively. The second pad 34*b* comprises a two-part pad. The pads 34*a,b* comprise a suitable resilient compressible padding material, such as foam rubber, for protecting the sports implement heads 4*a*. A strap assembly 36 includes first and second straps 36*a,b* mounted on the first and second arms 12*a,b* respectively and a hook-and-loop fastener 36*c* for releasably securing together the first and second straps 36*a,b*.

III. Tube Assembly 10

The tube assembly 10 includes inner and outer tubes 40*a,b*. The tubes 40*a,b* include respective upper ends 42*a,b*; lower ends 44*a,b*; and bores 46*a,b*. The inner tube upper end 42*a* mounts the second arm 12*b* adjacent to its proximate end 14*b* and its inner side 18*b*. A pair of annular friction rings 56 receive the inner tube 40*a* and are located in the outer tube bore 46*b* for frictionally resisting telescopic movement of the inner tube 40*a* within the outer tube 40*b*. The inner tube 40*a* is thus telescopically adjustably positioned at least partly within the outer tube 40*b* with each annular friction ring 56 in frictional, sliding engagement with one and/or both of the tubes 40*a,b*.

The overall length of the tube assembly 10 is adjustable by telescopically sliding the inner and outer tubes 40*a,b* with respect to each other. However, due to the frictional engagement of the friction rings 56 between the tubes 40*a,b*, the tube assembly 10 tends to hold a predetermined length. In operation, the inner tube 40*a* can be extended from and retracted into the outer tube 40*b* to accommodate different lengths of golf clubs 4.

A clip subassembly 48 includes a top member 48*a* mounted on the outer tube upper end 42*b* and extending laterally therefrom. Inner and outer legs 48*b,c* are mounted on the top member 48*a* and depend downwardly therefrom for capturing the golf bag rim 6*a* whereby the holder 2 is mounted on the golf bag 6. An insert 52 includes a passage 54 with a plurality of a radially-extending slots 54*a*. The insert 52 is frictionally received in the inner tube bore 46*a* and its passage 54 is adapted to releasably capture a golf club shaft 4*b*.

IV. Operation.

In operation, the implement holder 2 is adapted for mounting on a golf bag 6 to protect a golf club 4 therein. A plurality of the club holders 2 can be arrayed around the golf bag rim 6*a* for holding a set of clubs 4. The tube assembly 10 can be suitably length-adjusted to accommodate different types of clubs 4 and various other sports implements, such as hockey sticks, croquet mallets, etc.

It is to be understood that while certain forms of the present invention have been illustrated and described herein, it is not to be limited to the specific forms or arrangement of parts described and shown.

What is claimed and desired to be secured by Letters Patent is as follows:

1. A holder for golf clubs having a head and a shaft, which comprises:

(a) a head assembly including:
  1) first and second arms;
  2) each said arm having proximate and distal ends;
  3) each said arm having inner and outer sides;
  4) each said arm having upper and lower faces;
  5) said arms curving upwardly from their respective proximate ends to their respective distal ends;
  6) said second arm having a flange extending laterally from the proximate end thereof and said flange including a plurality of bolt receivers;
  7) a bolt receiver in said first arm;
  8) a mounting bolt extending through said respective flange receiver and said first arm receiver;
  9) a nut mounted on said bolt;
  10) a strap subassembly including a first strap mounted on said first arm, a second strap mounted on said second arm and a hook-and-loop fastener mounted on said straps for selectively connecting same; and
  11) first and second pads each comprising a resilient, compressible material and mounted on said upper faces of said first and second arms respectively; and (b) a tube assembly attached to one of said distal ends of said first and second arms and including:
  1) inner and outer tubes;
  2) each said tube including upper and lower ends;
  3) each said tube including a bore extending between its ends;
  4) a friction ring receiving said inner tube and positioned in said outer tube bore, said friction ring frictionally resisting telescopic sliding of said inner tube with respect to said outer tube, said friction ring frictionally engaging said inner and outer tubes with said inner tube telescopically received in said outer tube;
  5) an insert received in said inner tube bore and including an implement shaft passage including a plurality of radially-extending slots; and
  6) a clip subassembly including a clip top member mounted on said outer tube upper end and extending laterally therefrom, an inner leg connected to said clip top member and depending generally downwardly therefrom and an outer leg mounted on said clip top member in laterally-spaced relation from said inner leg, said outer leg depending downwardly from said top member.

2. A holder for an implement including a head and a shaft, which comprises:

(a) a head assembly including:
  1) first and second arms;
  2) each arm having proximate and distal ends;
  3) each arm having inner and outer sides;
  4) each arm having upper and lower faces;
  5) arm connection means for connecting said arms together; and
  6) an implement head receptacle formed by said arm upper faces; and (b) a tube assembly including:

1) a tube with upper and lower ends and a tube bore extending therebetween, said tube upper end being mounted on one of said arms;

2) one of said arms having a flange extending from the proximate end thereof; and (c) said arm connection means comprising a mechanical fastener fastening said flange to said other arm;

(d) said flange having a plurality of flange receivers;

(e) said other arm having an arm receiver aligned with a respective flange receiver; and (f) said mechanical fastener comprising a bolt received in said aligned receivers and a nut threadably mounted on said bolt.

* * * * *